US010816238B2

(12) United States Patent
Adachi et al.

(10) Patent No.: US 10,816,238 B2
(45) Date of Patent: Oct. 27, 2020

(54) INDOOR UNIT OF AIR-CONDITIONING APPARATUS

(71) Applicant: Mitsubishi Electric Corporation, Tokyo (JP)

(72) Inventors: Yusuke Adachi, Tokyo (JP); Takahiro Shishido, Tokyo (JP); Mitsuhiro Shirota, Tokyo (JP); Takashi Ikeda, Tokyo (JP); Yoshinori Tanikawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 216 days.

(21) Appl. No.: 15/765,134

(22) PCT Filed: Dec. 1, 2015

(86) PCT No.: PCT/JP2015/083753
§ 371 (c)(1),
(2) Date: Mar. 30, 2018

(87) PCT Pub. No.: WO2017/094116
PCT Pub. Date: Jun. 8, 2017

(65) Prior Publication Data

US 2018/0313572 A1 Nov. 1, 2018

(51) Int. Cl.

| | |
|---|---|
| ***F24F 1/00*** | (2019.01) |
| ***F24F 13/22*** | (2006.01) |
| ***F24F 13/14*** | (2006.01) |
| ***F24F 13/10*** | (2006.01) |
| ***F24F 13/20*** | (2006.01) |
| ***F24F 1/0011*** | (2019.01) |
| *F24F 1/0025* | (2019.01) |

(52) U.S. Cl.
CPC ..... *F24F 13/22* (2013.01); *F24F 1/0011* (2013.01); *F24F 13/10* (2013.01); *F24F 13/14* (2013.01);
(Continued)

(58) Field of Classification Search
CPC ..... F24F 13/22; F24F 1/0011; F24F 13/10; F24F 13/14; F24F 13/20; F24F 1/0025;
(Continued)

(56) References Cited

FOREIGN PATENT DOCUMENTS

| | | | |
|---|---|---|---|
| AU | 4031597 | A | 4/1998 |
| CN | 104422028 | A | 3/2015 |

(Continued)

OTHER PUBLICATIONS

Office Action dated Mar. 15, 2019 issued in corresponding CN patent application No. 201580058497.5 (and English translation).

(Continued)

*Primary Examiner* — Grant Moubry
*Assistant Examiner* — Ryan L Faulkner
(74) *Attorney, Agent, or Firm* — Posz Law Group, PLC

(57) ABSTRACT

An indoor unit of an air-conditioning apparatus eliminates a possibility of condensation on a front panel without deteriorating a quality of design. In an off state, an auxiliary air-directing plate is positioned above an up-down air-directing plate inside an air outlet such that a free end of the auxiliary air-directing plate opposite from one end of the auxiliary air-directing plate fixed to a rotating shaft is positioned closer to a rear surface of a casing than is the rotating shaft. In an on state, the auxiliary air-directing plate is rotated in a direction from the rear surface to a front surface of the casing, and the free end is protruded from the air outlet to an outside of the casing.

10 Claims, 8 Drawing Sheets

(52) U.S. Cl.
CPC ..... *F24F 13/20* (2013.01); *F24F 1/0025* (2013.01); *F24F 2013/221* (2013.01)

(58) Field of Classification Search
CPC .. F24F 2013/221; F24F 1/0007; F24F 1/0057; F24F 1/0314; F24F 1/62
USPC ..... 454/233
See application file for complete search history.

(56) References Cited

FOREIGN PATENT DOCUMENTS

| | | | |
|---|---|---|---|
| EP | 1380797 | A1 | 1/2004 |
| JP | S61-069728 | U | 5/1986 |
| JP | H10-089759 | A | 4/1998 |
| JP | 2007-093092 | A | 4/2007 |
| JP | 2009-085448 | A | 4/2009 |
| JP | 2009-121731 | A | 6/2009 |
| JP | 2010-121877 | A | 6/2010 |
| JP | 2014-134381 | A | 7/2014 |
| JP | 2015-048948 | A | 3/2015 |
| JP | 2015-068566 | A | 4/2015 |
| WO | 2010/058665 | A1 | 5/2010 |

OTHER PUBLICATIONS

International Search Report of the International Searching Authority dated Mar. 1, 2016 for the corresponding international application No. PCT/JP2015/083753 (and English translation).

Extended European Search Report dated Nov. 22, 2018 issued in corresponding EP patent application No. 15909746.8.

INDOOR UNIT OF AIR-CONDITIONING APPARATUS

CROSS REFERENCE TO RELATED APPLICATION

This application is a U.S. national stage application of PCT/JP2015/083753 filed on Dec. 1, 2015, the contents of which are incorporated herein by reference.

TECHNICAL FIELD

The present invention relates to an indoor unit of an air-conditioning apparatus, and in particular, relates to arrangement of an up-down air-directing plate and an auxiliary air-directing plate in an air outlet.

BACKGROUND ART

A traditional indoor unit of an air-conditioning apparatus includes a fan disposed in an air passage extending from an air inlet to an air outlet and a heat exchanger disposed around the fan. An indoor unit known in the art has an air outlet that opens only to a bottom surface of a casing of the indoor unit so that the air outlet is made inconspicuous for improved appearance.

For example, Patent Literature 1 discloses an indoor unit of an air-conditioning apparatus that has an air outlet disposed in a lower portion of a casing of the indoor unit. The air outlet is positioned at a higher level than a bottom surface of the casing. The air outlet has sloping surfaces extending downward from the periphery of the air outlet such that one of the sloping surfaces extends forward and the other one of them extends rearward. The indoor unit includes an up-down air-directing plate in the air outlet. The up-down air-directing plate covers the air outlet in an off state. Consequently, the air outlet and the air-directing plate are not visible to a user in the off state. In an on state, the up-down air-directing plate is moved downward to open the air outlet, so that air is blown forward or downward.

Patent Literature 2 discloses an air-conditioning apparatus that includes a casing having sloping surfaces in a lower portion of the casing such that the sloping surfaces extend to a front surface of the apparatus. The air-conditioning apparatus has an air outlet defined by the sloping surfaces. The air-conditioning apparatus further includes a horizontal flap, serving as a relatively large up-down air-directing plate, and a diffuser, serving as a relatively small up-down air-directing plate, arranged in the air outlet. The horizontal flap is disposed on a side of a rear surface of the apparatus, and the diffuser is disposed on a side of the front surface. In the on state, the diffuser and the horizontal flap cause air to be blown forward or downward. In the off state, the diffuser is retracted along a wall of the air outlet that is disposed on a side of the front surface, and the air outlet is covered by the horizontal flap. The air outlet and the air-directing plates are not visible to a user in the off state.

CITATION LIST

Patent Literature

Patent Literature 1: Japanese Unexamined Patent Application Publication No. 2015-068566

Patent Literature 2: Japanese Unexamined Patent Application Publication No. 2010-121877

SUMMARY OF INVENTION

Technical Problem

As disclosed in Patent Literature 1, while the indoor unit of an air-conditioning apparatus is performing a cooling operation, part of cooled air blown from a fan flows along an upper wall of the air outlet. The cooled air directly cools a part of a front panel disposed close to the air outlet. In addition, the front panel disposed next to the upper wall, cooled directly by the cooled air, of the air outlet is cooled by heat conduction. Consequently, air surrounding the part of the front panel in proximity to the air outlet is cooled to the dew point temperature or lower, causing condensation on the front panel. When the cooling operation is continued, drops of water on the front panel increase in amount and finally fall from the casing and spoil, for example, furniture, a floor, and a wall surrounding the indoor unit.

To prevent an end of the upper wall of the air outlet from being exposed to cooled air, a stationary protrusion can be disposed on the upper wall of the air outlet such that the protrusion extends along the longitudinal direction of the air outlet. In this case, however, the protrusion may interfere with the up-down air-directing plate in the on or off state. Furthermore, the protrusion is exposed even in the off state, degrading the quality of design.

As disclosed in Patent Literature 2, the diffuser is disposed in the air outlet on a side of the front surface. Protruding the diffuser from the air outlet enables the front panel, serving as a design surface of the air-conditioning apparatus, to be less likely to be exposed to cooled air, thus preventing condensation on the front panel. However, as the diffuser is configured to rotate in a direction from the front surface to the rear surface, the diffuser has to be increased in size to reduce the cooled air flowing to the front panel. Increasing the size of the diffuser requires a storage space for the diffuser. Meanwhile, when the diffuser is downsized to reduce the storage space, cooled air tends to flow to the design surface, which is the front surface. In such a case, the front panel needs to be vertically separated from the air outlet, that is, the height of the casing needs to be increased. Furthermore, to prevent cooled air from being applied to the front panel, a surface in front of the air outlet needs to slope upward, or serve as a sloping surface facing forward such that the surface is apart from the cooled air blown from the air outlet. These requirements restrict the shape of the front panel of the air-conditioning apparatus, the shape of a bottom panel, and the position of the air outlet of the front panel of the air-conditioning apparatus, reducing flexibility in appearance design. As a result, the air outlet is disposed at a position at which the air outlet is visible when the air-conditioning apparatus is viewed from the front. Disadvantageously, the internal structure of the apparatus is visible in the on state, resulting in degraded design quality.

The present invention has been made to solve the above-described problems and provides an indoor unit of an air-conditioning apparatus that enhances flexibility in appearance design and prevents condensation on a front surface of a casing of the indoor unit.

Solution to Problem

An embodiment of the present invention provides an indoor unit of an air-conditioning apparatus including a casing having a rear surface to be mounted to an indoor wall, an air inlet provided in the casing, an air outlet that opens to a bottom surface of the casing, a heat exchanger and an air-sending device each arranged in an air passage extending from the air inlet to the air outlet, and an up-down air-directing plate disposed and rotatably supported in the air outlet. The up-down air-directing plate covers the air outlet in an off state. In an on state, the up-down air-directing plate is rotated and adjusted in angle to adjust a direction of air blown from the air outlet in an up-down direction. The indoor unit further includes an auxiliary air-directing plate disposed along a longitudinal direction of the air outlet and a rotating shaft about which the auxiliary air-directing plate rotates, disposed inside the air outlet and on a side of a front surface of the casing. In the off state, the auxiliary air-directing plate is positioned inside the air outlet such that a free end of the auxiliary air-directing plate opposite from one end of the auxiliary air-directing plate fixed to the rotating shaft is positioned closer to the rear surface than is the rotating shaft. In the on state, the auxiliary air-directing plate is rotated in a direction from the rear surface to the front surface of the casing, and the free end is protruded from an air outlet to an outside of the casing.

Advantageous Effects of Invention

According to an embodiment of the present invention, the auxiliary air-directing plate is positioned in a front part of the air outlet and the free end of the auxiliary air-directing plate is protruded from the air outlet to the outside of the casing in a cooling operation of an air-conditioning apparatus, so that cooled air blown from the fan flows along the auxiliary air-directing plate. Consequently, the auxiliary air-directing plate blocks the flow of the cooled air, so that the cooled air flow is less likely to be applied directly to a lower end of a front panel, serving as the front surface of the casing. This arrangement prevents the front panel from being cooled. Furthermore, a part of the inside of the air outlet closer to the front surface than the auxiliary air-directing plate is also less likely to be cooled. This arrangement prevents the front panel from being cooled by heat conduction. Advantageously, this arrangement eliminates the possibility of condensation on the front panel. In addition, as the auxiliary air-directing plate is retracted inside the casing in the off state, the design quality of the indoor unit does not degrade in the off state.

DESCRIPTION OF EMBODIMENTS

Figure 1:
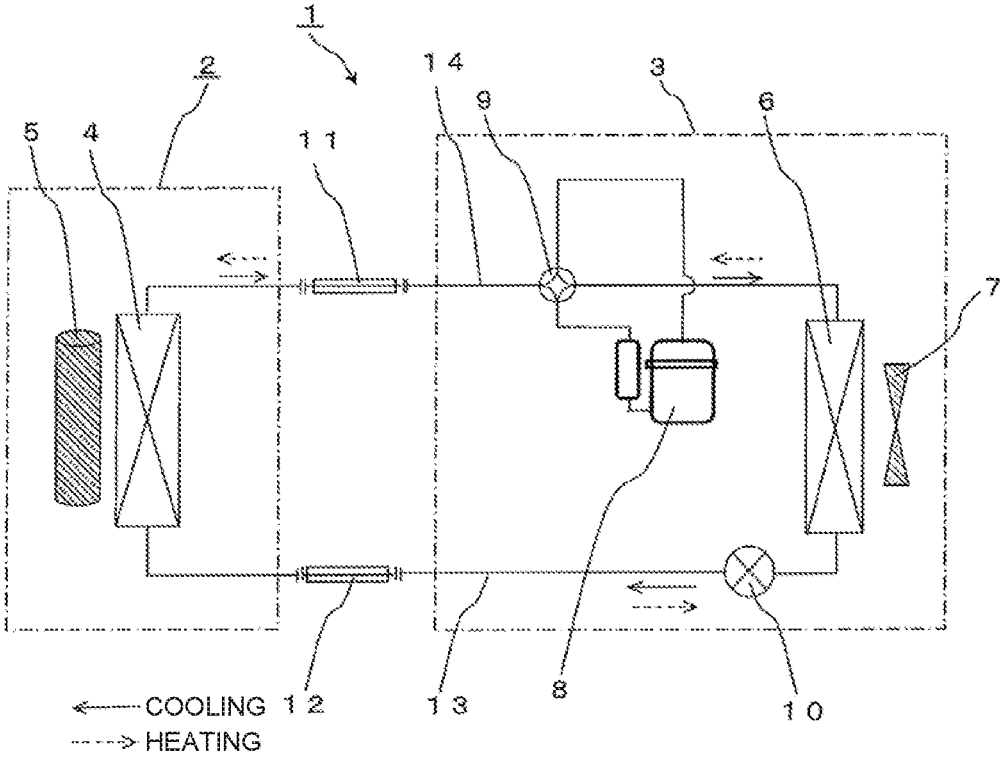
FIG. 1 is a schematic diagram illustrating a refrigerant circuit of an air-conditioning apparatus in Embodiment 1 of the present invention.

Embodiments of the present invention are described below with reference to the drawings. Note that devices and other components designated by the same reference signs in the drawings are the same devices and components or equivalents. This note applies to the following description of the specification. Furthermore, note that the forms of components described in the specification are intended to be illustrative only and the present invention is not intended to be limited only to those described in the specification. In particular, combination patterns of the components are not intended to be limited only to those in the embodiments. A component in one embodiment can be used in another embodiment. Furthermore, when a plurality of devices of the same type distinguished from one another using subscripts do not have to be distinguished from one another or specified, the subscripts may be omitted. Furthermore, note that the size relationship between the components in the drawings may differ from the actual one.

Embodiment 1

<Configuration of Refrigerant Circuit 13 of Air-Conditioning Apparatus 1>

FIG. 1 is a schematic diagram illustrating a refrigerant circuit of an air-conditioning apparatus 1 in Embodiment 1 of the present invention. As illustrated in FIG. 1, the air-conditioning apparatus 1 includes an indoor unit 2 and an outdoor unit 3 that are connected by a gas-side connecting pipe 11 and a liquid-side connecting pipe 12 to form the refrigerant circuit 13. The indoor unit 2 accommodates an indoor heat exchanger 4 that is connected to refrigerant pipes connected to the outside of the indoor unit 2. The outdoor unit 3 accommodates a four-way switching valve 9, a compressor 8, an outdoor heat exchanger 6, and an expansion valve 10 that are connected by refrigerant pipes. As described above, the refrigerant circuit 13 includes the indoor heat exchanger 4, the four-way switching valve 9, the compressor 8, the outdoor heat exchanger 6, and the expansion valve 10 connected by the refrigerant pipes to form a refrigeration cycle. In addition, an indoor air-sending device 5 is disposed close to the indoor heat exchanger 4 and an outdoor air-sending device 7 is disposed close to the outdoor heat exchanger 6.

<Configuration of Outdoor Unit 3>

In the outdoor unit 3, the expansion valve 10, the outdoor heat exchanger 6, and the four-way switching valve 9 are connected in series by the refrigerant pipes. The four-way switching valve 9 is connected to the outdoor heat exchanger 6, a suction port and a discharge port of the compressor 8, and the refrigerant pipe connecting to the gas-side connecting pipe 11. The four-way switching valve 9 is capable of switching between a heating operation and a cooling operation by changing connection destinations of the discharge and suction ports. When the four-way switching valve 9 has a passage state indicated by solid lines in FIG. 1, the refrigerant pipe connecting to the gas-side connecting pipe 11 is connected to the suction port of the compressor 8, and the discharge port of the compressor 8 is connected to the outdoor heat exchanger 6. In this case, the air-conditioning apparatus 1 performs the cooling operation. When the four-way switching valve 9 has a passage state indicated by dashed lines in FIG. 1, the outdoor heat exchanger 6 is connected to the suction port of the compressor 8, and the discharge port of the compressor is connected to the refrigerant pipe connecting to the gas-side connecting pipe 11. In this case, the air-conditioning apparatus 1 performs the heating operation.

<Configuration of Indoor Unit 2>

Figure 2:
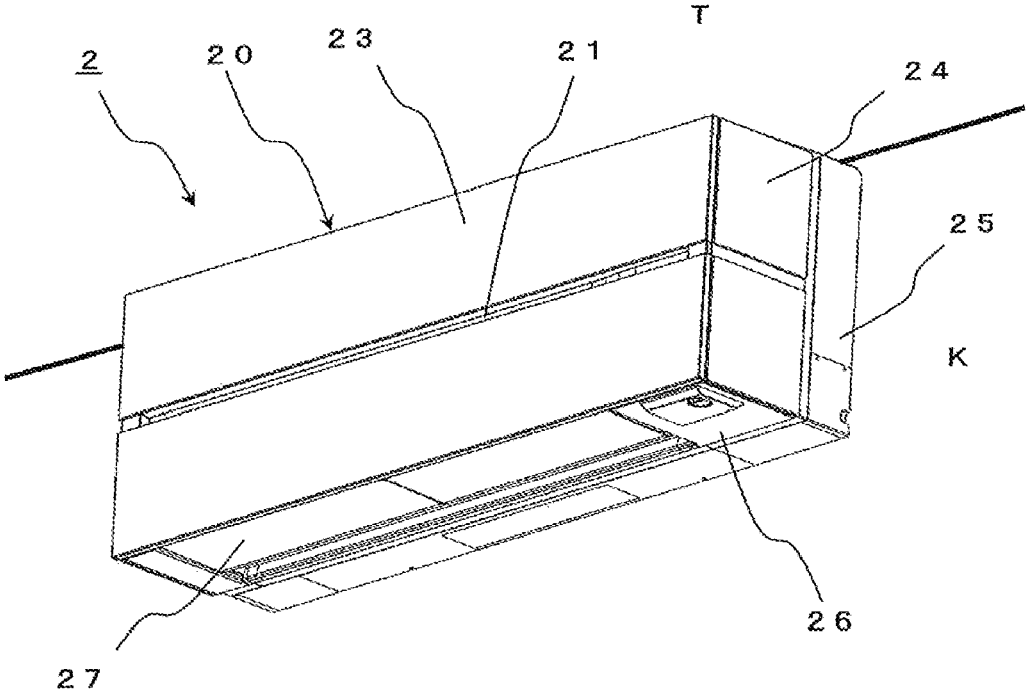
FIG. 2 is a perspective view of an indoor unit of the air-conditioning apparatus in Embodiment 1 of the present invention.
Figure 3:
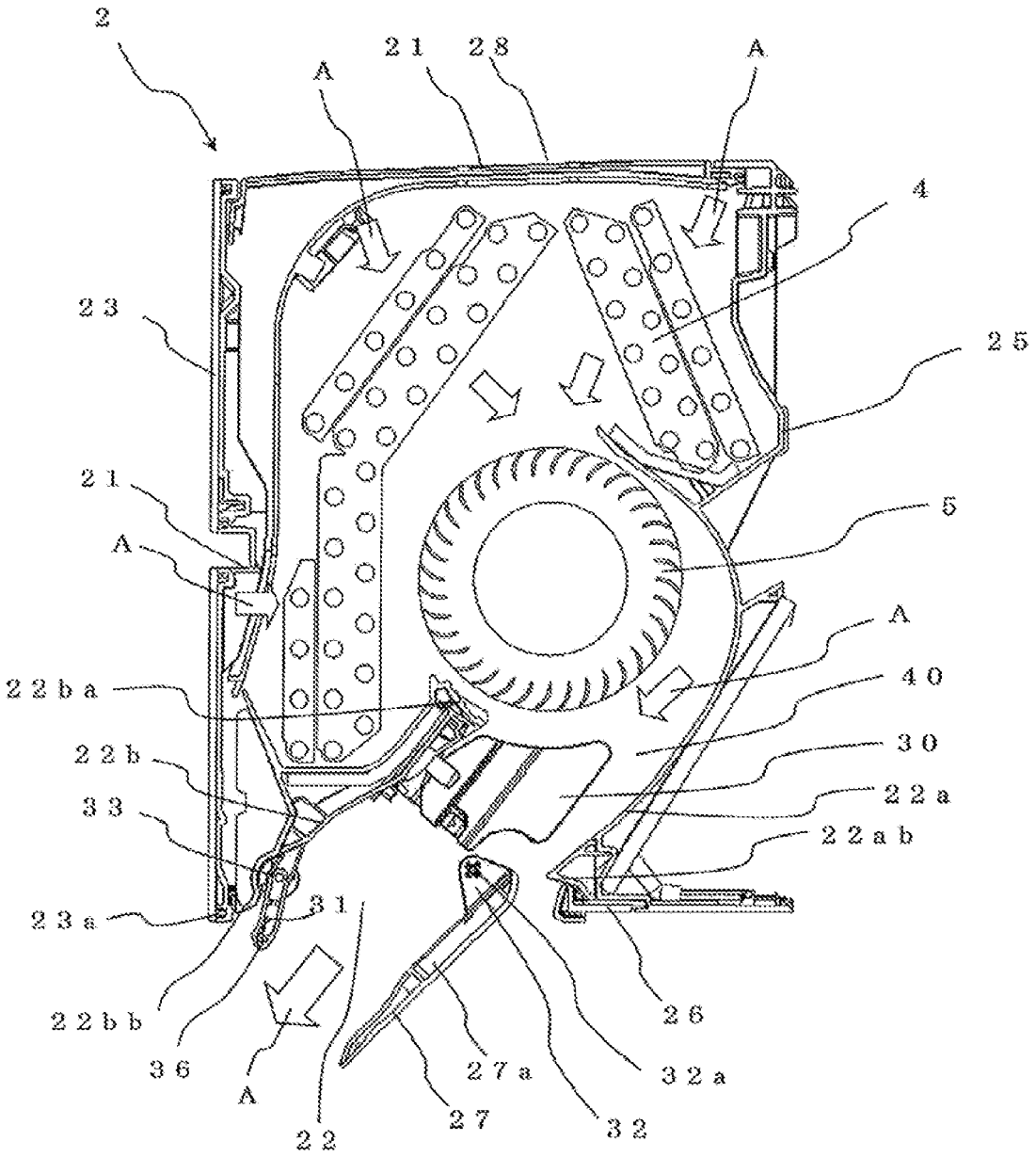
FIG. 3 is an explanatory diagram illustrating a cross-section of the indoor unit of FIG. 2 perpendicular to the longitudinal direction of the indoor unit.

FIG. 2 is a perspective view of the indoor unit 2 of the air-conditioning apparatus 1 in Embodiment 1 of the present invention. FIG. 3 is an explanatory diagram illustrating a cross-section of the indoor unit 2 of FIG. 2 perpendicular to the longitudinal direction of the indoor unit 2. FIG. 3 illustrates an on state of the indoor unit 2. In FIG. 2, an indoor space in which the indoor unit 2 is installed has a ceiling T. The indoor unit 2 is mounted on a wall K. In the following description, the term "rear surface" refers to a surface of the indoor unit 2 adjacent to the wall K, the term "front surface" refers to a surface opposite the rear surface of the indoor unit 2, the term "top surface" refers to a surface of the indoor unit 2 adjacent to the ceiling T, the term "bottom surface" refers to a surface opposite the top surface of the indoor unit 2, the term "right side surface" refers to a surface of the indoor unit 2 on the right of FIG. 2, and the term "left side surface" refers to a surface opposite the right side surface of the indoor unit 2. These terms are similarly used to describe components inside the indoor unit 2.

As illustrated in FIG. 2, the indoor unit 2 includes a laterally long, rectangular parallelepiped casing 20. The front surface of the casing 20 is covered by a front panel 23, the right and left side surfaces of the casing 20 are covered by side panels 24, and the rear surface of the casing 20 is covered by a rear panel 25. The front panel 23 extends parallel to the wall K. The front panel 23 has a recess, serving as an air inlet 21. Except for the recess, the front panel 23 serves as a flat surface extending from the top surface to the bottom surface. The front panel 23 has a lower end 23*a*, serving as a front end of the bottom surface of the casing 20. The bottom surface of the casing 20 is covered by the rear panel 25, a bottom panel 26, and an up-down air-directing plate 27. The top surface of the casing 20 is covered by a top panel 28. The top panel 28 has openings arranged in a lattice pattern. These openings serve as air inlets 21. The bottom panel 26 extends parallel to a floor of the indoor space. The shape of the casing 20 of the indoor unit 2 is not limited to such a laterally long, rectangular-parallelepiped shape in FIG. 2. The casing 20 may have any box-like shape that has one or more air inlets 21 through which air is sucked into the casing 20 and one or more air outlets 22 through which air is blown out of the casing 20, provided that the bottom panel 26 is disposed parallel to the floor and the air outlet 22 opens to the bottom panel.

As illustrated in FIG. 2, the indoor unit 2 according to Embodiment 1 has a laterally long, rectangular-parallelepiped shape, and the air outlet 22 is provided only in the bottom surface of the casing 20 such that the air outlet is disposed close to the front panel. As long as the indoor unit 2 has such a configuration, the air outlet 22 is not visible when the indoor unit 2 in an off state is viewed from the front. This arrangement results in improved design quality. Furthermore, such a configuration facilitates downward blowing of air in the on state, so that the air can reach the floor.

As illustrated in FIG. 3, the casing 20 accommodates the indoor air-sending device 5 driven by a motor (not illustrated) to produce a flow of air. The indoor heat exchanger 4 is disposed around the indoor air-sending device 5 such that the indoor heat exchanger 4 is interposed between the indoor air-sending device 5 and the top and front surfaces. An air passage 40 extending to the air outlet 22 is provided below the indoor air-sending device 5. A left-right air-directing plate 30 for adjusting the direction of air flow in a left-right direction is disposed on a front wall 22*b* of the air outlet 22 such that the left-right air-directing plate 30 is positioned upstream of the air outlet 22 in the air passage 40. In the air outlet 22, the up-down air-directing plate 27 and an auxiliary air-directing plate 31 are each arranged to adjust the direction of air flow in an up-down direction. The flow of air inside the indoor unit 2 is indicated by arrows A in FIG. 3. The up-down air-directing plate 27 and the auxiliary air-directing plate 31 enable the air blown in the on state to be directed not only downward but also forward.

<Air Passage 40 and Air Outlet 22>

Figure 4:
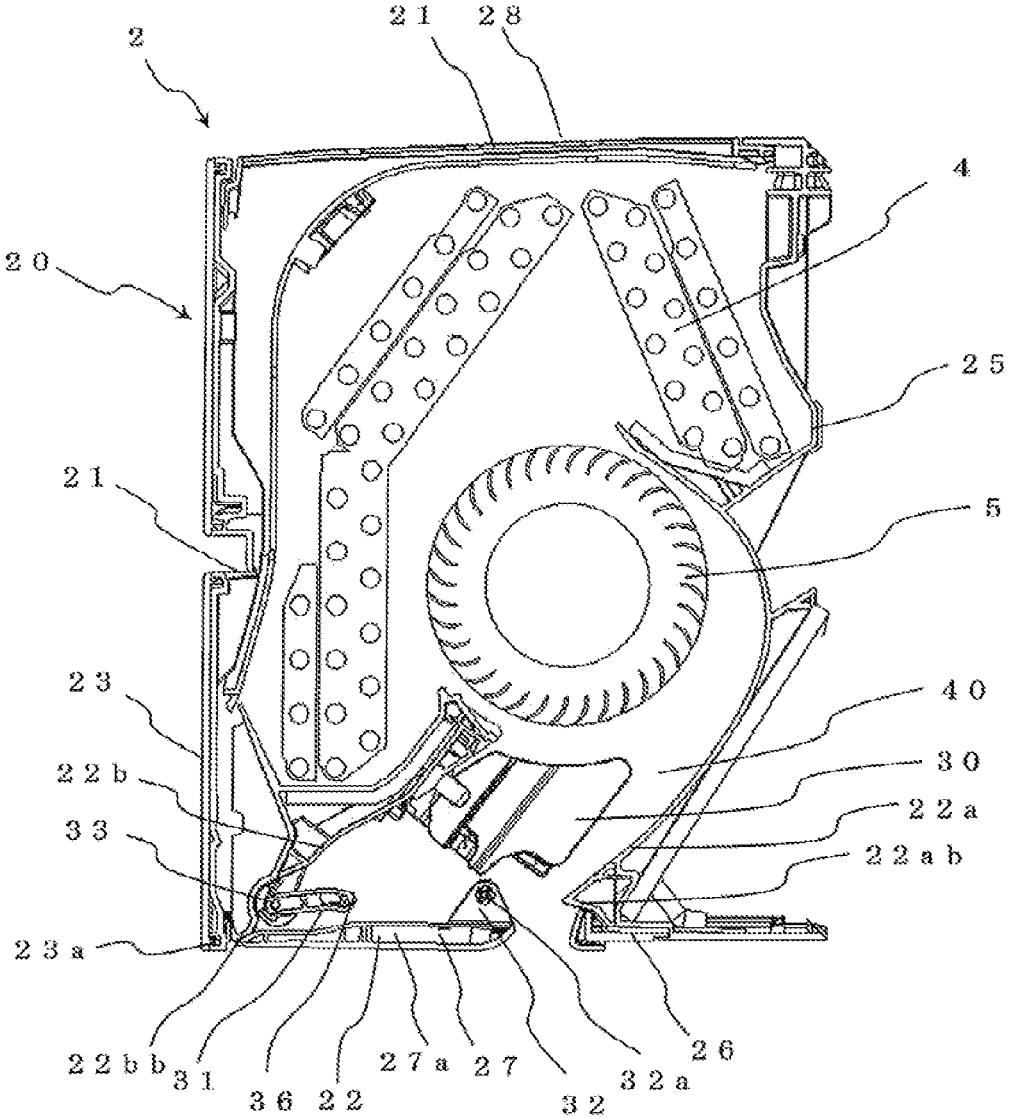
FIG. 4 is an explanatory diagram illustrating a cross-section of the indoor unit of FIG. 2 perpendicular to the longitudinal direction of the indoor unit in an off state.

FIG. 4 is an explanatory diagram illustrating a cross-section of the indoor unit 2 of FIG. 2 perpendicular to the longitudinal direction of the indoor unit 2 in the off state. The air passage 40 includes the front wall 22*b* on a side of the front surface and a rear wall 22*a* on a side of the rear surface. The rear wall 22*a* extends downward from an area between the indoor air-sending device 5 and the rear surface to extend around the indoor air-sending device 5 and reaches the air outlet 22. In other words, the rear wall 22*a* serves as a slope extending from the area between the indoor air-sending device 5 and the rear surface toward the front surface. The rear wall 22*a* has a lower end 22*ab* in contact with an inner part of the bottom panel 26.

The front wall 22*b* of the air outlet 22 has an upper end 22*ba* positioned under the indoor air-sending device 5 and on a side of the front surface. The front wall 22*b* extends obliquely downward toward the front surface and reaches the air outlet 22. The front wall 22*b* has a lower end 22*bb*, serving as an end on a side of the air outlet 22, positioned just behind the lower end 23*a* of the front panel 23 of the indoor unit 2.

<Up-down Air-directing Plate 27>

The up-down air-directing plate 27 is attached to a rotating shaft 32*a* and is supported rotatably about the rotating shaft 32*a*. The rotating shaft 32*a* is positioned in the air outlet 22 on a side of the rear surface. The rotating shaft 32*a* is disposed close to the rear wall 22*a* of the air outlet 22. The rotating shaft 32*a* is disposed across a gap 29 from the lower end 22*ab* of the rear wall 22*a*. In the on state, the up-down air-directing plate 27 is opened, cooled air is blown through the gap 29, and the cooled air flows along an outer surface of the up-down air-directing plate 27. The up-down air-directing plate 27 includes a plate-shaped portion 27*a* extending along the longitudinal direction of the air outlet 22 and a supporting member 32 protruding from the plate-shaped portion. The supporting member 32 is attached to the rotating shaft 32*a*. The up-down air-directing plate 27 moves the plate-shaped portion 27*a* in the up-down direction through the supporting member 32 to change the direction of air blown from the air outlet 22 in the up-down direction. As illustrated in FIG. 3, in the on state, the up-down air-directing plate 27 is rotated downward about the rotating shaft 32*a* to open the air outlet 22, and the angle of rotation of the up-down air-directing plate 27 is adjusted to adjust the direction of blown air in the up-down direction.

The indoor unit 2 illustrated in FIGS. 2 and 4 is in the off state. The up-down air-directing plate 27 covers the air outlet 22. In the off state of the indoor unit 2, a free end of the plate-shaped portion 27*a* of the up-down air-directing plate reaches an end of an opening of the air outlet 22 on a side of the front surface, or the lower end 22*bb* of the front wall 22*b*. The plate-shaped portion 27*a* of the up-down air-directing plate 27 closes the air outlet 22 so that the inside of the air outlet 22 is not visible.

The up-down air-directing plate 27 is rotatable about the rotating shaft 32*a* in a range from an upper structural limit (fully closed position) to a lower structural limit (fully opened position) by driving a driving motor (not illustrated).

<Auxiliary Air-Directing Plate 31>

The front wall 22*b* is positioned in the air outlet 22 on a side of the front surface and above the up-down air-directing plate 27. A rotating shaft 33 about which the auxiliary air-directing plate rotates is disposed close to a surface of the front wall 22*b* facing the air passage. The rotating shaft 33 is spaced from the front wall 22*b*. Furthermore, the rotating shaft 33 is positioned closer to the inside of the casing than the opening of the air outlet 22. When the up-down air-directing plate 27 covers the air outlet 22, the rotating shaft 33 is positioned above the up-down air-directing plate 27. The auxiliary air-directing plate 31 is supported by the rotating shaft 33 such that the auxiliary air-directing plate 31 is rotatable about the rotating shaft 33 in a front-rear direction of the casing 20. The auxiliary air-directing plate 31 is rotatable about the rotating shaft 33 by 90 degrees or more. The auxiliary air-directing plate 31 extends along the longitudinal direction of the air outlet 22, or laterally in the indoor unit 2. The auxiliary air-directing plate 31 changes the direction of air blown from a part of the air outlet 22 on a side of the front surface in the up-down direction.

As illustrated in FIG. 3, in the on state of the air-conditioning apparatus 1, an opposite end of the auxiliary air-directing plate 31 from the rotating shaft 33, or a free end 36 that is not supported by the rotating shaft 33 is positioned below the rotating shaft 33, and a part of the auxiliary air-directing plate 31 is protruded from the air outlet 22 to the outside of the casing 20. Specifically, the air-conditioning apparatus 1 is operated with the free end 36 of the auxiliary air-directing plate 31 extending downward from the lower end of the front panel 23. In this state, the air also flows through the space between the rotating shaft 33 and the front wall 22*b*.

As illustrated in FIG. 4, in the off state of the air-conditioning apparatus 1, the auxiliary air-directing plate 31 is retracted inside the air outlet 22. While the up-down air-directing plate 27 closes the air outlet 22, the rotating shaft 33 and the auxiliary air-directing plate 31 are positioned closer to the inside of the casing than the up-down air-directing plate 27, or above the up-down air-directing plate 27. In this state, the free end 36 of the auxiliary air-directing plate 31 is positioned at a higher level than the rotating shaft 33 and closer to the rear surface of the casing 20 than the rotating shaft 33. While the up-down air-directing plate 27 covers the air outlet 22, the free end 36 of the auxiliary air-directing plate 31 is positioned closer to the rear surface than the rotating shaft 33. When the auxiliary air-directing plate 31 is in a retracted state, the free end 36 has rotated and is positioned closer to the rear surface than the rotating shaft 33. For the position of the rotating shaft 33 in the front-rear direction inside the air outlet 22, therefore, the rotating shaft 33 can be disposed close to the front panel 23. In other words, the rotating shaft 33 can be disposed in close proximity to the lower end 23*a* of the front panel 23. For the position of the rotating shaft 33 in the up-down direction, the rotating shaft 33 is disposed as low as possible inside the air outlet 22 such that the rotating shaft 33 does not interfere with the up-down air-directing plate 27 in the fully closed position. As described above, the rotating shaft 33 for the auxiliary air-directing plate 31 is disposed close to the front surface in the front-rear direction and as low as possible in the up-down direction inside the air outlet 22. Such a configuration enables the auxiliary air-directing plate 31 to protrude from the air outlet 22 by a large amount in the on state of the air-conditioning apparatus and also enables the auxiliary air-directing plate 31 to be disposed in close proximity to the lower end 23*a* of the front panel 23. Although the amount by which the auxiliary air-directing plate 31 is protruded from the air outlet 22 can be increased by increasing the size of the auxiliary air-directing plate 31, the auxiliary air-directing plate 31 can be made compact by disposing the rotating shaft 33 for the auxiliary air-directing plate 31 close to the front surface and as low as possible inside the air outlet 22 as described above.

<Air Flow in Indoor Unit 2 in Embodiment 1>

The air flow inside the indoor unit 2 is described below with reference to FIG. 3. In FIG. 3, the arrows A indicate the air flow inside the indoor unit 2. Air sucked through the air inlets 21 arranged in the top and front surfaces of the indoor unit 2 passes through the indoor heat exchanger 4 and exchanges heat with refrigerant flowing inside the indoor heat exchanger 4. The air passing through the indoor heat exchanger 4 is cooled in the cooling operation of the air-conditioning apparatus 1 or heated in the heating operation of the air-conditioning apparatus 1. The conditioned air, which has passed through the indoor heat exchanger 4 and has exchanged heat with the refrigerant, reaches the indoor air-sending device 5. The air passes through the indoor air-sending device 5 or a space between the indoor air-sending device 5 and the rear panel 25 and then passes through the air passage 40. The direction of the air is adjusted in the left-right direction by the left-right air-directing plate 30. The air passing the left-right air-directing plate 30 flows along the up-down air-directing plate 27 and the auxiliary air-directing plate 31 arranged in the air outlet 22 and is then blown forward or downward from the air outlet 22 of the indoor unit 2.

<Air Flow in Indoor Unit 2 without Auxiliary Air-Directing Plate 31>

Figure 5:
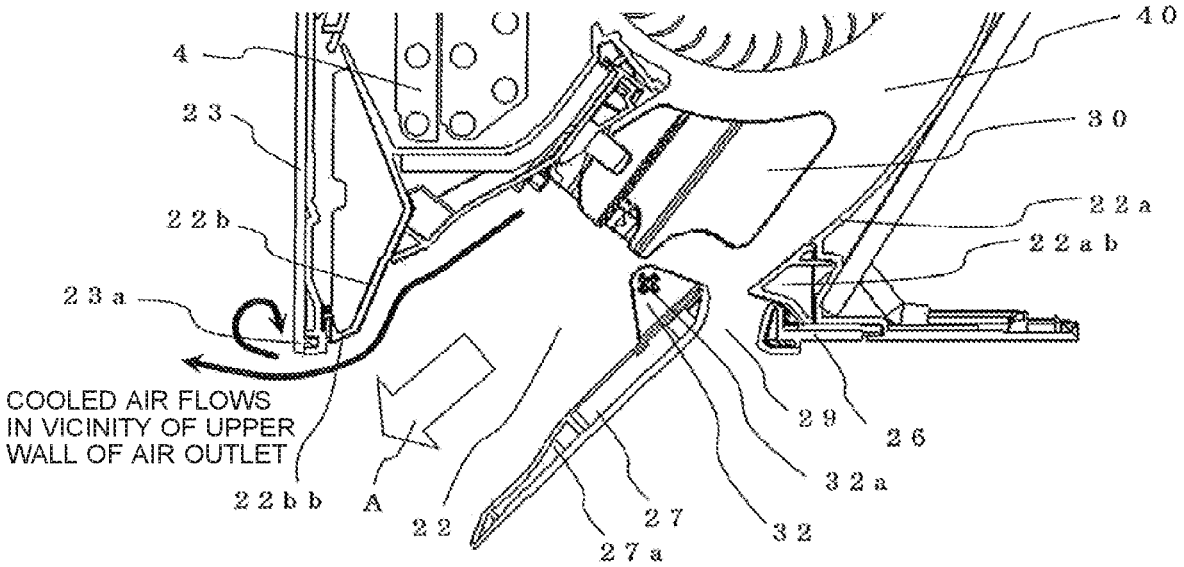
FIG. 5 is an explanatory diagram illustrating Comparative Example in which an auxiliary air-directing plate is eliminated from the indoor unit of FIG. 3 and illustrates a section of a part including an air outlet of an indoor unit.

FIG. 5 is an explanatory diagram illustrating Comparative Example in which the auxiliary air-directing plate 31 is eliminated from the indoor unit 2 of FIG. 3 and illustrates a section of a part including the air outlet 22. In the air outlet 22 with no auxiliary air-directing plate 31, cooled air blown in the cooling operation flows along the front wall 22*b* of the air outlet 22 as indicated by an arrow in FIG. 5. The cooled air comes into contact with the front panel 23 in proximity to the opening of the air outlet 22, thus cooling the front panel 23. A low flow speed of air blown from the air outlet 22 causes part of the cooled air blown from the air outlet 22 to become a swirl at the end of the air outlet 22 on a side of the front surface as illustrated in FIG. 5. The swirl may come into contact with the front panel 23. Furthermore, when the cooled air does not directly come into contact with the front panel 23 but cools a part of the front wall 22*b* in proximity to the opening of the air outlet 22, the front panel 23 in contact with the front wall 22*b* of the air outlet 22 is cooled by heat conduction. The air surrounding the front panel 23, directly cooled by the cooled air or cooled by heat conduction, in proximity to the air outlet 22 is cooled to the dew-point temperature or lower, causing condensation on the front panel 23 in proximity to the air outlet 22. When the air-conditioning apparatus 1 continues the cooling operation, drops of water on the front panel 23 may finally fall from the casing 20 and spoil, for example, furniture, a floor, and the wall surrounding the indoor unit 2.

<Air Flow in Indoor Unit 2 with Auxiliary Air-Directing Plate 31>

Figure 6:
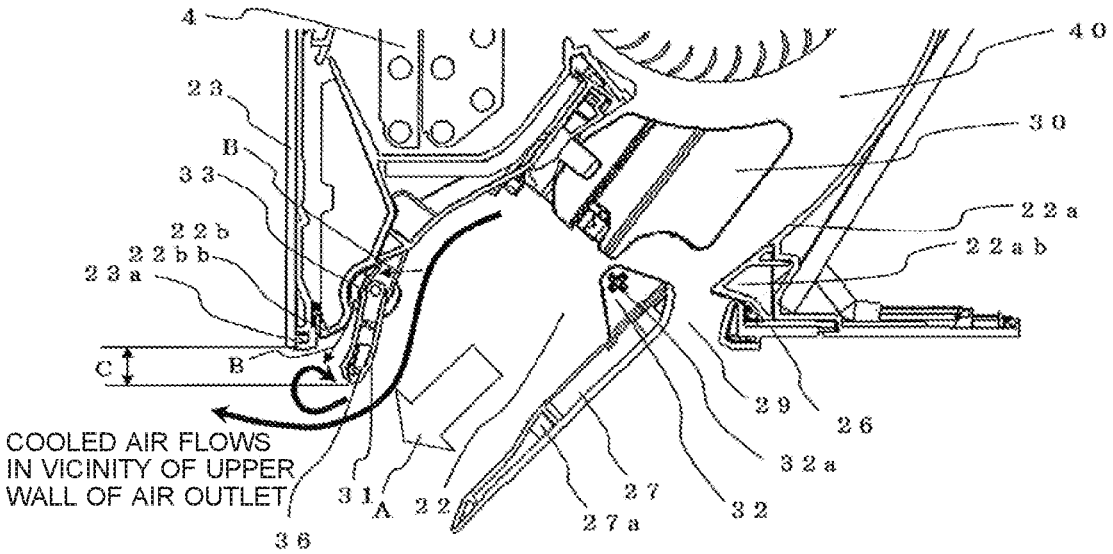
FIG. 6 is an explanatory diagram illustrating a section of a part including an air outlet of the indoor unit of FIG. 3.

FIG. 6 is an explanatory diagram illustrating a section of a part including the air outlet 22 of the indoor unit 2 of FIG. 3. FIG. 6 depicts a state of the air outlet 22 in the cooling operation. In the air outlet 22 with the auxiliary air-directing plate 31 disposed on a side of the front surface, cooled air blown along the front wall 22*b* of the air outlet 22 in the cooling operation flows along the auxiliary air-directing plate 31 as indicated by an arrow in FIG. 6 and is then blown from the air outlet 22. The auxiliary air-directing plate 31 causes the air, which flows along the front wall 22*b* of the air outlet 22 and is then blown from the end of the air outlet 22 on a side of the front surface, to flow downward. This configuration reduces or eliminates the likelihood that the blown cooled air may come into contact with the front panel 23. Consequently, the front panel 23 is not cooled by blown air.

In the on state of the air-conditioning apparatus 1, the auxiliary air-directing plate 31 is protruded out of the casing 20 as illustrated in FIG. 6. When the blown air flows at a low speed or when a swirl of cooled air occurs close to the opening of the air outlet 22 as described above, the protruded auxiliary air-directing plate 31 can reduce or eliminate the likelihood that cooled air may come into contact with the front panel 23. Furthermore, the auxiliary air-directing plate 31 prevents the lower end 22*bb* of the front wall 22*b* of the air outlet 22 from being aggressively cooled by the cooled air indicated by the arrow A. Thus, the front panel 23 is not cooled by heat conduction. As described above, the auxiliary air-directing plate 31, disposed as illustrated in FIG. 5, prevents the front panel 23 from being cooled directly or indirectly by cooled air. Consequently, the front panel 23 has substantially the same temperature as that of the ambient air, so that condensation does not occur on the front panel 23. It is advantageous that the auxiliary air-directing plate 31 be positioned as close to the lower end 23*a* of the front panel 23 as possible and be protruded as much as possible from the air outlet 22, because these positional conditions of the auxiliary air-directing plate 31 readily allow the lower end 23*a* to be less likely to be exposed to cooled air.

The rotating shaft 33 is spaced from the front wall 22*b*. As indicated by a arrow B in FIG. 6, cooled air of a small amount flows on a front-surface side of the auxiliary air-directing plate 31. Such a configuration reduces the difference in temperature between the air on the front-surface side of the auxiliary air-directing plate 31 protruded from the air outlet and the air on a rear-surface side of the auxiliary air-directing plate 31, thus preventing condensation on the auxiliary air-directing plate 31. As the cooled air coming into contact with the front panel 23 has a small amount, condensation does not occur on the front panel 23.

<Operation of Auxiliary Air-Directing Plate 31 During Cooling>

As illustrated in FIG. 4, in the off state of the air-conditioning apparatus 1, the auxiliary air-directing plate 31 rotated about the rotating shaft 33 is retracted such that the free end 36 is positioned at a higher level than the rotating shaft 33. The auxiliary air-directing plate 31 in the retracted state is positioned above the up-down air-directing plate 27 such that the auxiliary air-directing plate 31 is not visible from the outside. Such a configuration improves the design quality in the off state as the auxiliary air-directing plate 31 is not visible. As the auxiliary air-directing plate 31 is retracted such that the free end 36 of the auxiliary air-directing plate 31 is positioned at a higher level than the rotating shaft 33, the auxiliary air-directing plate 31 does not interfere with the up-down air-directing plate 27 in the fully closed position. Furthermore, as the free end 36 of the auxiliary air-directing plate 31 can be positioned and retracted at a higher level than the rotating shaft 33, the rotating shaft 33 can be disposed close to the outside of the air outlet 22. Advantageously, this arrangement achieves a reduction in distance between the rotating shaft 33 and the free end of the auxiliary air-directing plate 31 as well as a large amount of protrusion of the auxiliary air-directing plate 31 from the air outlet 22.

When the air-conditioning apparatus 1 starts the cooling operation, the auxiliary air-directing plate 31 is rotated such that its free end moves in a direction from the rear surface to the front surface, so that the free end 36 is protruded from the air outlet 22 as illustrated in FIGS. 3 and 6. To reduce or eliminate the contact of cooled air indicated by the arrow A in FIG. 3 with the front panel 23, the free end 36 of the auxiliary air-directing plate 31 is protruded downward from the lower end 23*a* of the front panel 23. In this case, the amount C by which the free end 36 of the auxiliary air-directing plate 31 is protruded from the lower end 23*a* of the front panel in the up-down direction needs to be greater than or equal to 5 mm, preferably 10 mm. As the rotating shaft 33 for the auxiliary air-directing plate 31 is disposed on a side of the front panel 23 inside the air outlet 22, the auxiliary air-directing plate 31 protruded from the air outlet 22 is positioned close to the lower end 23*a* of the front panel 23. This arrangement can effectively reduce or eliminate contact of blown air indicated by the arrow A in FIG. 6 with the lower end 23*a* even when the auxiliary air-directing plate 31 has a small size.

<Operation of Auxiliary Air-Directing Plate 31 During Heating>

Figure 7:
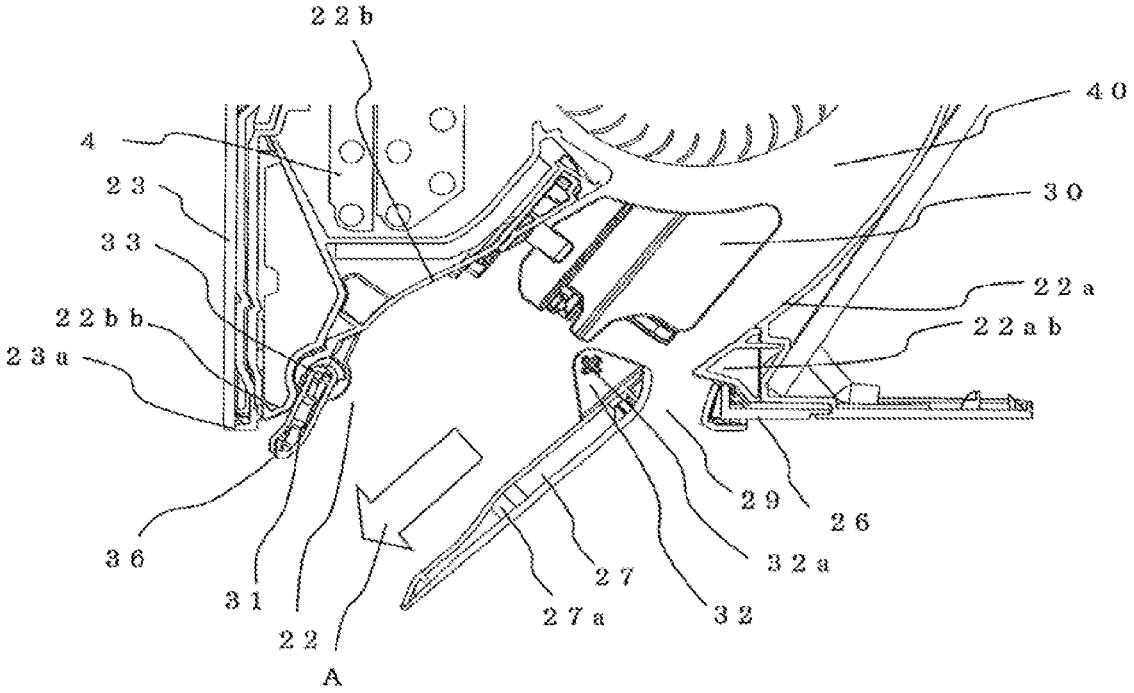
FIG. 7 is an explanatory diagram illustrating a section of the indoor unit perpendicular to the longitudinal direction of the indoor unit during heating in Embodiment 1 of the present invention.

FIG. 7 is an explanatory diagram illustrating a section of the indoor unit 2 perpendicular to the longitudinal direction of the indoor unit 2 during heating in Embodiment 1 of the present invention. When the heating operation is performed, similarly, the auxiliary air-directing plate 31 is rotated about the rotating shaft 33 from the retracted state illustrated in FIG. 4 such that the free end 36 moves in the direction from the rear surface to the front surface, so that the free end 36 is protruded from the air outlet 22. In this case, the auxiliary air-directing plate 31 is rotated until it comes into contact with the lower end 22*bb* of the front wall 22*b* as illustrated in FIG. 7, instead of being stopped such that the surface of the auxiliary air-directing plate 31 on a side of the front surface is spaced from the lower end 22*bb* of the front wall 22*b* as illustrated in FIG. 4. Consequently, a small air passage, through which a diverted air flow of a small amount passes, on the front-surface side of the auxiliary air-directing plate 31 can be closed. This configuration reduces pressure loss of blown air during heating, thus preventing a reduction in air flow rate. In the heating operation, the components arranged in proximity to the air outlet 22 are not cooled by blown air. It is therefore unnecessary to consider condensation prevention.

Figure 8:
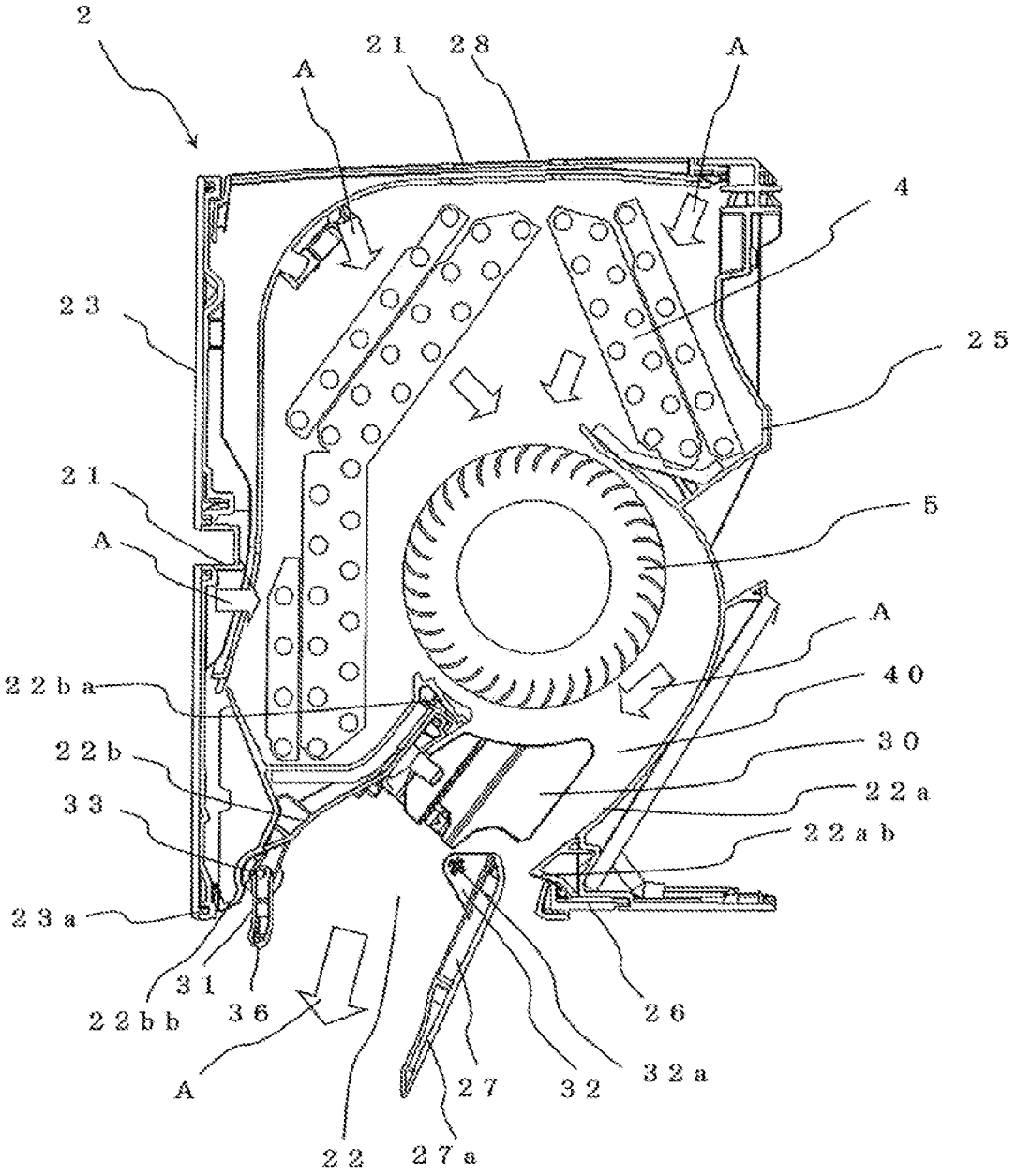
FIG. 8 is an explanatory diagram illustrating a cross-section of the indoor unit perpendicular to the longitudinal direction of the indoor unit in a downward blowing operation mode.

FIG. 8 is an explanatory diagram illustrating a cross-section of the indoor unit 2 perpendicular to the longitudinal direction of the indoor unit 2 in a downward blowing operation mode. To direct the blown air downward in each of the cooling operation and the heating operation, as illustrated in FIG. 8, the up-down air-directing plate 27 is directed downward at 65 to 90 degrees and the auxiliary air-directing plate 31 is directed downward at 85 to 90 degrees from the horizontal direction. Thus, the air can be blown substantially straight down. This arrangement achieves a wider air blowing range than that of traditional air-conditioning apparatuses.

<Structure of Auxiliary Air-Directing Plate 31>

Figure 9:
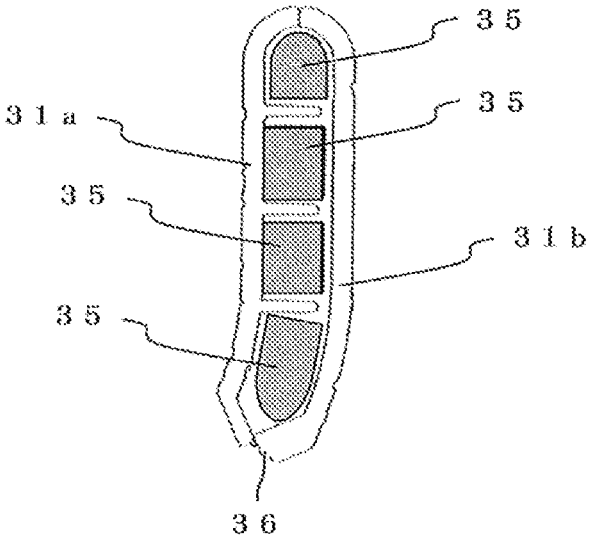
FIG. 9 is an explanatory diagram illustrating a section of the structure of the auxiliary air-directing plate in Embodiment 1 of the present invention.

FIG. 9 is an explanatory diagram illustrating a section of the structure of the auxiliary air-directing plate 31 in Embodiment 1 of the present invention. As illustrated in FIG. 9, the auxiliary air-directing plate 31 includes two components: a front portion 31*a* and a rear portion 31*b*. The front portion 31*a* and the rear portion 31*b* may define a cavity between them. The cavity causes the front portion 31*a* to be less likely to be cooled by heat conduction when the rear portion 31*b* of the auxiliary air-directing plate 31 is cooled by cooled air, thus reducing an amount of condensation or eliminating condensation on the front portion 31*a*. To enhance thermal insulation, a heat insulating material 35 may optionally be disposed in the cavity between the front portion 31*a* and the rear portion 31*b*.

Embodiment 2

Embodiment 2 relates to a modification of the manner of retracting and protruding the auxiliary air-directing plate 31 in Embodiment 1. The following description is focused on differences between Embodiment 2 and Embodiment 1. Items not particularly mentioned in Embodiment 2 are similar to those in Embodiment 1, and the same functions and components as those in Embodiment 1 are designated by the same reference signs in the following description.

Figure 10:
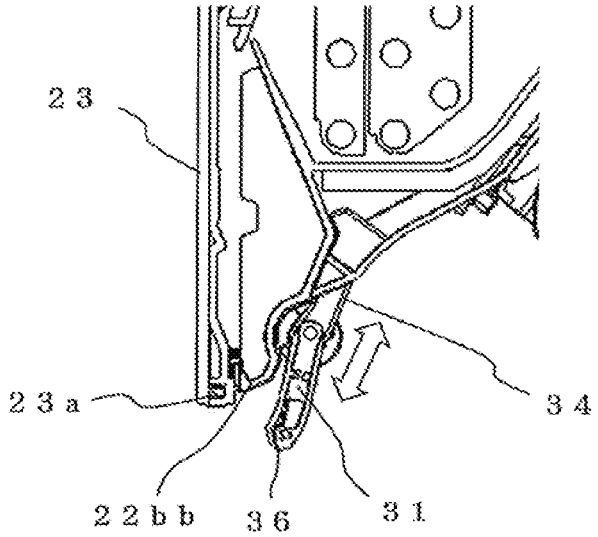
FIG. 10 is an enlarged view of an auxiliary air-directing plate and its surrounding part of an indoor unit in Embodiment 2 of the present invention.

FIG. 10 is an enlarged view of the auxiliary air-directing plate 31 and its surrounding part of the indoor unit 2 in Embodiment 2 of the present invention. The auxiliary air-directing plate 31 can be configured without any mechanism for rotating about the rotating shaft 33. As illustrated in FIG. 10, the auxiliary air-directing plate 31 may be movable up and down along guide grooves 34 arranged in right and left wall surfaces inside the air outlet 22. The auxiliary air-directing plate 31 may be movable in directions indicated by arrows in FIG. 10 and be retracted in the front wall 22*b*. Moving the auxiliary air-directing plate 31 up and down as described above can adjust the direction of air flow in the up-down direction and the amount of protrusion of the auxiliary air-directing plate 31 from the air outlet 22. A smaller angle of the up-down air-directing plate 27 from the horizontal direction (45 degrees or less at which the up-down air-directing plate 27 is downwardly inclined to the horizontal) in the cooling operation causes the cooled air blown from the air outlet 22 to be more likely to come into contact with the front panel 23. In this case, however, increasing the amount of protrusion of the auxiliary air-directing plate 31 from the casing 20 can cause the flow of the cooled air in a part of the air outlet 22 on a side of the front surface to be directed downward, thus preventing condensation on the front panel 23. Conversely, a larger angle of the up-down air-directing plate 27 from the horizontal direction (45 degrees or greater at which the up-down air-directing plate 27 is downwardly inclined to the horizontal) in the cooling operation causes the cooled air blown from the air outlet 22 to flow further downward. In this case, when the amount of protrusion of the auxiliary air-directing plate 31 from the casing 20 is reduced, condensation does not occur on the front panel 23. As described above, reducing the amount of protrusion of the auxiliary air-directing plate 31 from the air outlet 22 can increase the area of opening of the air outlet 22. This configuration results in a reduction in pressure loss of blown air, leading to improved performance of the air-conditioning apparatus 1. Furthermore, cooled air is not blown from the indoor unit 2 in the heating operation or an air-sending operation. It is therefore unnecessary to protrude the auxiliary air-directing plate 31 from the air outlet 22 to the outside. The area of opening of the air outlet 22 can be increased, resulting in a reduction in pressure loss of blown air. This configuration leads to improved performance of the air-conditioning apparatus 1.

Embodiment 3

Embodiment 3 relates to a modification of the retracted state of the auxiliary air-directing plate 31 in Embodiment 1. The following description is focused on differences between Embodiment 3 and Embodiment 1. Items not particularly mentioned in Embodiment 3 are similar to those in Embodiment 1, and the same functions and components as those in Embodiment 1 are designated by the same reference signs in the following description.

Figure 11:
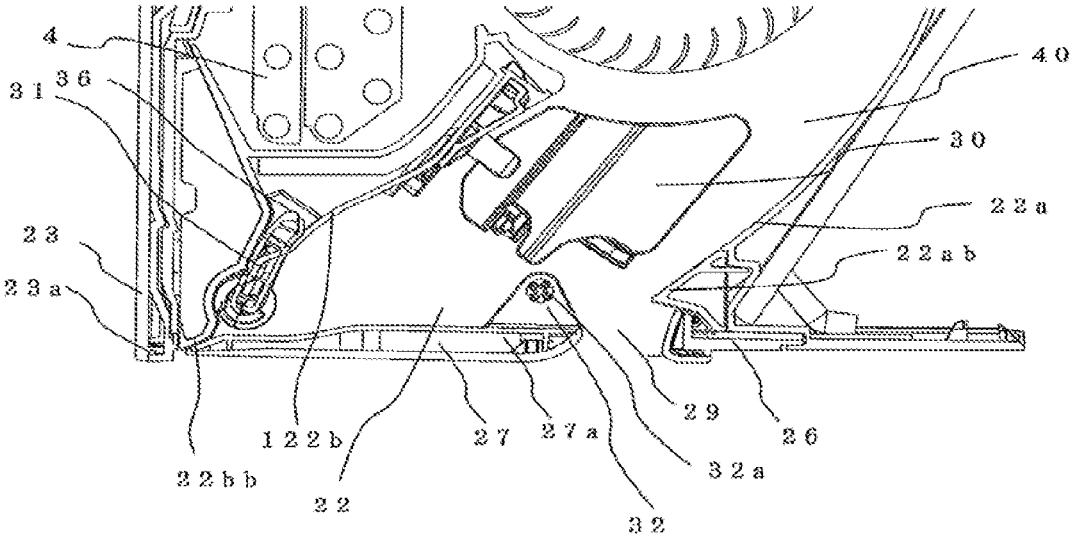
FIG. 11 is an explanatory diagram illustrating a section of a part including an air outlet of an indoor unit in Embodiment 3 of the present invention perpendicular to the longitudinal direction of the indoor unit.

FIG. 11 is an explanatory diagram illustrating a section of a part including the air outlet 22 of the indoor unit 2 in Embodiment 3 of the present invention perpendicular to the longitudinal direction of the indoor unit 2. FIG. 11 illustrates the off state of the air-conditioning apparatus 1. The up-down air-directing plate 27 covers the air outlet 22. In this state, the auxiliary air-directing plate 31 is received in a recess of a front wall 122*b* of the air outlet 22. The auxiliary air-directing plate 31 is received such that its free end does not protrude from the recess of the front wall 122*b*. Such a configuration leaves a space inside the air outlet 22 in the off state, leading to flexibility in arrangement of the left-right air-directing plate, for example.

Figure 12:
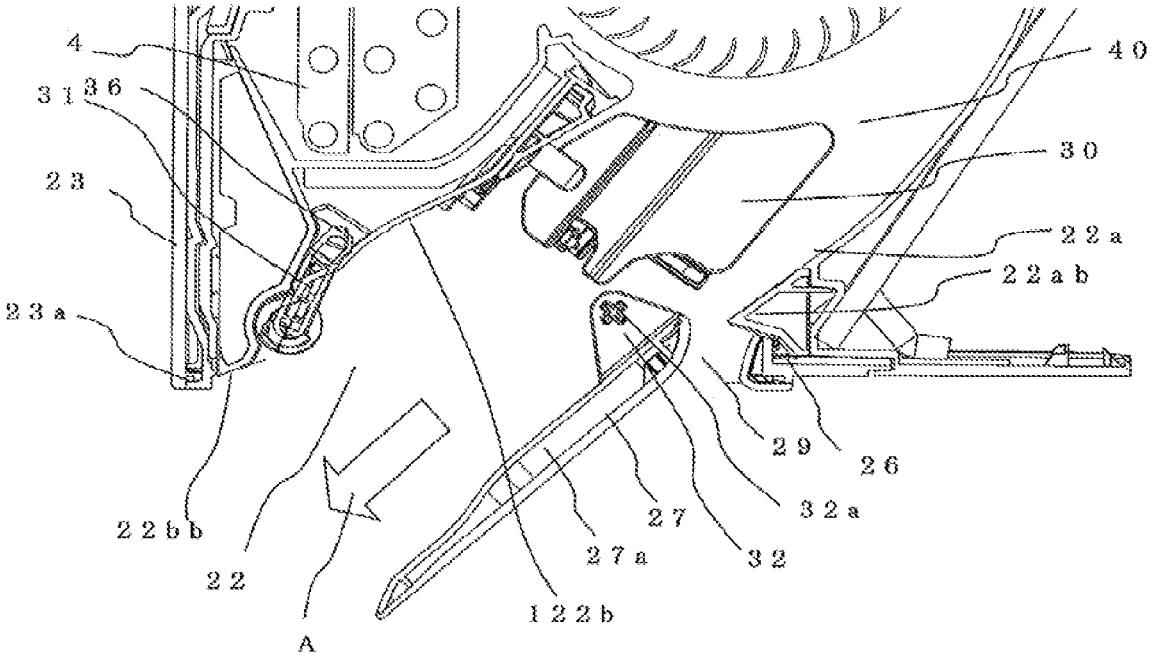
FIG. 12 is a diagram illustrating an on state changed from an off state in FIG. 11.

FIG. 12 is a diagram illustrating the on state changed from the off state of FIG. 11. FIG. 12 illustrates the on state in the heating operation. In this state, the auxiliary air-directing plate 31 remains received in the recess of the front wall 122*b*. As condensation does not occur on the front panel 23 and other parts in the heating operation, the auxiliary air-directing plate 31 may remain received in the recess in the heating operation. As the auxiliary air-directing plate 31 is received in the front wall 22*b* such that the free end of the auxiliary air-directing plate 31 does not protrude to the air passage, such arrangement reduces pressure loss of heated air flowing through the air passage. Furthermore, this arrangement enables the area of opening of the air outlet 22 to be greater than that in the arrangement in Embodiment 1 in which the auxiliary air-directing plate 31 is protruded from the air outlet 22, reducing pressure loss of heated air blown as indicated by an arrow A in FIG. 12. The air-conditioning apparatus 1 achieves efficient operation.

The auxiliary air-directing plate 31 in Embodiment 3 works in the cooling operation in a manner similar to that in Embodiment 1. Advantages similar to those in Embodiment 1 are accordingly obtained.

Advantageous Effects of Invention

The indoor unit 2 of the air-conditioning apparatus 1 according to each of Embodiments 1 to 3 of the present invention includes the casing 20 having the rear surface to be mounted to an indoor wall, the air inlets 21 arranged in the casing 20, the air outlet 22 that opens to the bottom surface of the casing 20, the indoor heat exchanger 4 and the indoor air-sending device 5 arranged in the air passage extending from the air inlets 21 to the air outlet 22, and the up-down air-directing plate 27 disposed and rotatably supported in the air outlet 22. In the off state, the up-down air-directing plate 27 covers the air outlet 22. In the on state, the up-down air-directing plate 27 is rotated and adjusted in angle to adjust the direction of air blown from the air outlet 22 in the up-down direction. The indoor unit 2 further includes the auxiliary air-directing plate 31 disposed along the longitudinal direction of the air outlet 22 and the rotating shaft 33, about which the auxiliary air-directing plate 31 rotates in the front-rear direction of the casing 20, disposed on a side of the front surface of the casing 20 inside the air outlet 22. In the off state, the auxiliary air-directing plate 31 is positioned inside the air outlet 22, and the free end 36 of the auxiliary air-directing plate 31 opposite from the end of the auxiliary air-directing plate 31 fixed to the rotating shaft 33 is positioned closer to the rear surface than the rotating shaft 33. In the on state, the auxiliary air-directing plate 31 is rotated in the direction from the rear surface to the front surface of the casing 20, and the free end 36 is protruded from the air outlet 22 to the outside of the casing 20.

In the cooling operation of the indoor unit 2 of the air-conditioning apparatus 1 with such a configuration, the auxiliary air-directing plate 31 blocks cooled air, and the cooled air is less likely to be directly applied to the lower end 23*a* of the front panel 23 of the casing 20, thus eliminating the likelihood that the front panel 23 may be cooled. In addition, the part of the inside of the air outlet closer to the front surface than the auxiliary air-directing plate 31 is also less likely to be cooled, thus eliminating the likelihood that the front panel 23 may be cooled by heat conduction. Advantageously, this configuration prevents condensation on the front panel 23. Additionally, the auxiliary air-directing plate 31 is retracted inside the casing 20 in the off state of the air-conditioning apparatus 1. Advantageously, such arrangement prevents degradation in design quality of the indoor unit 2 in the off state. In addition, as the free end 36 of the auxiliary air-directing plate 31 is positioned closer to the rear surface than the rotating shaft 33 for the auxiliary air-directing plate 31, the rotating shaft 33 can be disposed close to the front panel. Advantageously, such arrangement causes the cooled air to be less likely to flow toward the front panel, even when the auxiliary air-directing plate 31 is small. Additionally, the air outlet 22 opening to the bottom surface of the casing 20 can be disposed next to the front panel 23 in the indoor unit 2 as in Embodiments 1 and 2, advantageously leading to increased flexibility in appearance design of the casing 20 of the indoor unit 2.

In the indoor unit 2 of the air-conditioning apparatus 1 according to each of Embodiments 1 and 3 of the present invention, the free end 36 of the auxiliary air-directing plate 31 is positioned at a higher level than the rotating shaft 33 in the off state. In the on state, the auxiliary air-directing plate 31 is rotated about the rotating shaft 33 by 90 degrees or more, so that the free end is protruded from the air outlet 22 to the outside of the casing 20.

Such a configuration allows the auxiliary air-directing plate 31 to be retracted without interfering with the up-down air-directing plate 27 when the up-down air-directing plate 27 covers the air outlet 22. This configuration enables efficient arrangement of the components.

In the indoor unit 2 of the air-conditioning apparatus 1 according to each of Embodiments 1 and 3 of the present invention, the rotating shaft 33 is spaced from the front wall 22*b* of the air outlet 22 disposed on a side of the front surface, and the auxiliary air-directing plate 31 is spaced from the front wall 22*b* in the cooling operation.

Such a configuration provides an air passage, through which a cooled air of a small amount flow passes, between the auxiliary air-directing plate 31 and the lower end 22*bb* of the front wall 22*b* in the cooling operation. This configuration reduces the difference in temperature between the front-surface side and the rear-surface side of the auxiliary air-directing plate 31 in the cooling operation, thus reducing or eliminating condensation on the auxiliary air-directing plate 31.

In the indoor unit 2 of the air-conditioning apparatus 1 according to each of Embodiments 1 and 3 of the present invention, the auxiliary air-directing plate 31 is in contact with the front wall 22*b* in the heating operation.

Such a configuration closes the air passage between the auxiliary air-directing plate 31 and the lower end 22*bb* of the front wall 22*b* in the heating operation to prevent division of the air flow through the air outlet 22, reduce pressure loss of blown air, and achieve a sufficient air flow rate, in addition to reducing or eliminating condensation on the auxiliary air-directing plate 31 and the front panel 23 in the cooling operation.

In the indoor unit 2 of the air-conditioning apparatus 1 according to each of Embodiments 1 to 3 of the present invention, the front wall 22*b* has the recess for receiving the auxiliary air-directing plate 31, and the free end 36 of the auxiliary air-directing plate 31 does not protrude from the front wall 22*b* to the air passage.

Such a configuration leaves a space inside the air outlet 22 in the off state of the air-conditioning apparatus 1, achieving efficient arrangement of the components. As the heating operation can be performed while the auxiliary air-directing plate 31 remains received in the recess, the air outlet 22 is allowed to have a large area of opening. This configuration achieves less pressure loss of blown air than the case where the heating operation is performed while the auxiliary air-directing plate 31 is protruded from the air outlet 22, thus suppressing a reduction in air flow rate.

In the indoor unit 2 of the air-conditioning apparatus 1 according to each of Embodiments 1 to 3 of the present invention, the auxiliary air-directing plate 31 has a hollow structure inside the auxiliary air-directing plate 31.

Such a configuration provides a cavity. When the rear portion 31*b* of the auxiliary air-directing plate 31 is cooled by cooled air, the cavity causes the front portion 31*a* to be less likely to be cooled by heat conduction, preventing condensation on the front portion 31*a*.

In the indoor unit 2 of the air-conditioning apparatus 1 according to each of Embodiments 1 to 3 of the present invention, the auxiliary air-directing plate 31 includes the heat insulating material 35 inside the auxiliary air-directing plate 31. Such a configuration achieves a higher level of thermal insulation than the configuration with only the cavity, thus preventing condensation on the auxiliary air-directing plate 31.

In the indoor unit 2 of the air-conditioning apparatus 1 according to each of Embodiments 1 to 3 of the present invention, the casing 20 has a rectangular-parallelepiped shape. Advantageously, such a configuration prevents condensation on the front panel 23 and enables the casing 20 to have high design quality.

REFERENCE SIGNS LIST

1 air-conditioning apparatus 2 indoor unit 3 outdoor unit 4 indoor heat exchanger 5 indoor air-sending device 6 outdoor heat exchanger 7 outdoor air-sending device 8 compressor 9 four-way switching valve 10 expansion valve 11 gas-side connecting pipe 12 liquid-side connecting pipe 13 refrigerant circuit 20 casing 21 air inlet 22 air outlet 22*a* rear wall 22*ab* lower end 22*b* front wall 22*ba* upper end 22*bb* lower end 23 front panel 23*a* lower end 24 side panel 25 rear panel 26 bottom panel 27 up-down air-directing plate 28 top panel 30 left-right air-directing plate 31 auxiliary air-directing plate 31*a* front portion 31*b* rear portion 32 supporting member 32*a* rotating shaft 33 rotating shaft 34 guide groove 35 heat insulating material 36 free end (of the auxiliary air-directing plate) 40 air passage 122*b* front wall

The invention claimed is:

1. An indoor unit of an air-conditioning apparatus, the indoor unit comprising:

a casing having a rear surface to be mounted to an indoor wall;

a front panel serving as a front surface of the casing, the front panel having a lower end serving as a front end of a bottom surface of the casing;

an air inlet provided in the casing;

an air outlet that opens to the bottom surface;

a heat exchanger and an indoor air-sending device each arranged in an air passage extending from the air inlet to the air outlet;

an up-down air-directing plate disposed and rotatably supported in the air outlet, the up-down air-directing plate covering the air outlet in an off state, the up-down air-directing plate being rotated and adjusted in angle to adjust a direction of air blown from the air outlet in an up-down direction in an on state;

an auxiliary air-directing plate disposed along a longitudinal direction of the air outlet; and a rotating shaft about which the auxiliary air-directing plate rotates, the rotating shaft being disposed inside the air outlet near the front surface of the casing, the rotating shaft being spaced from a front wall that is a wall of a front surface side of the air outlet, the front wall being disposed on a side of a front surface of the air passage extending from the indoor air-sending device to the air outlet, the front wall having a recess that receives the auxiliary air-directing plate, the rotating shaft being positioned above the lower end of the front panel and below the recess of the front wall, in the off state, the auxiliary air-directing plate being positioned inside the air outlet such that a free end of the auxiliary air-directing plate opposite from one end of the auxiliary air-directing plate fixed to the rotating shaft is positioned closer to the rear surface than is the rotating shaft, in the on state, the auxiliary air-directing plate being rotated in a direction from the rear surface to the front surface of the casing, and the free end being protruded from the air outlet to an outside of the casing such that the free end extends downward from the lower end of the front panel, and in a cooling operation, the auxiliary air-directing plate being spaced from the front wall.

2. The indoor unit of an air-conditioning apparatus of claim 1, wherein, in the off state, the free end of the auxiliary air-directing plate is positioned at a higher level than the rotating shaft, and wherein, in the on state, the auxiliary air-directing plate is rotated about the rotating shaft by 90 degrees or more, and the free end is protruded from the air outlet to the outside of the casing.

3. The indoor unit of an air-conditioning apparatus of claim 2, wherein the auxiliary air-directing plate is in contact with the front wall in a heating operation.

4. The indoor unit of an air-conditioning apparatus of claim 2, wherein, in a received state, the free end of the auxiliary air directing plate does not protrude from the recess of the front into the air passage.

5. The indoor unit of an air-conditioning apparatus of claim 1, wherein the auxiliary air-directing plate is in contact with the front wall in a heating operation.

6. The indoor unit of an air-conditioning apparatus of claim 5, wherein, in a received state, the free end of the auxiliary air directing plate does not protrude from the recess of the front wall into the air passage.

7. The indoor unit of an air-conditioning apparatus of claim 1, wherein, in a received state, the free end of the auxiliary air directing plate does not protrude from the recess of the front wall into the air passage.

8. The indoor unit of an air-conditioning apparatus of claim 1, wherein the auxiliary air-directing plate includes an internal cavity that is hollow.

9. The indoor unit of an air-conditioning apparatus of claim 1, wherein the auxiliary air-directing plate includes an internal cavity filled with a heat insulating material inside the auxiliary air-directing plate.

10. The indoor unit of an air-conditioning apparatus of claim 1, wherein the casing has a rectangular-parallelepiped shape.

* * * * *